US006181224B1

(12) United States Patent
Glinder

(10) Patent No.: US 6,181,224 B1
(45) Date of Patent: Jan. 30, 2001

(54) WAVEGUIDE FILTER WITH A RESONATOR CAVITY HAVING INNER AND OUTER EDGES OF DIFFERENT LENGTHS

(75) Inventor: Per Olof Glinder, Göteborg (SE)

(73) Assignee: Telefonaktiebolaget LM Ericsson (publ), Stockholm (SE)

( * ) Notice: Under 35 U.S.C. 154(b), the term of this patent shall be extended for 0 days.

(21) Appl. No.: 09/195,992

(22) Filed: Nov. 20, 1998

(30) Foreign Application Priority Data

Nov. 21, 1997 (SE) ..... 9704267

(51) Int. Cl.[7] ..... H01P 1/208; H01P 11/00

(52) U.S. Cl. ..... 333/208; 333/212; 333/249; 29/600

(58) Field of Search ..... 333/208, 209, 333/212, 249; 29/600

(56) References Cited

U.S. PATENT DOCUMENTS 4,439,747 * 3/1984 Kreinheder ..... 333/208
4,677,402 * 6/1987 Cesani et al. ..... 333/212 X
4,772,863 * 9/1988 Rosenberg et al. ..... 333/208 X
5,576,674 * 11/1996 Jachowski ..... 333/212
5,739,734 * 4/1998 Chen et al. ..... 333/209 X

FOREIGN PATENT DOCUMENTS 0736923 10/1996 (EP) .
58-161403 9/1983 (JP) .
58-187001 11/1983 (JP) .
9301625 1/1993 (WO) .

* cited by examiner

*Primary Examiner*—Benny Lee
*Assistant Examiner*—Barbara Summons
(74) *Attorney, Agent, or Firm*—Burns, Doane, Swecker & Mathis, L.L.P.

(57) ABSTRACT

A waveguide filter includes one or more resonator cavities which extend between an input to the filter and an output from the filter. Each resonator cavity in the filter has a center line with a chosen extension and a mechanical length. The mechanical length of the center line of each resonator cavity forms one of the parameters that determine the electrical length of the resonator cavity. The filter forms part of a microwave unit. At least one of the resonator cavities of the filter has a curved extension with respect to its center line.

21 Claims, 5 Drawing Sheets

WAVEGUIDE FILTER WITH A RESONATOR CAVITY HAVING INNER AND OUTER EDGES OF DIFFERENT LENGTHS

This application claims priority under 35 U.S.C. §§119 and/or 365 to 9704267-5 filed in Sweden on Nov. 21, 1997; the entire content of which is hereby incorporated by reference.

TECHNICAL FIELD

The present invention relates to a waveguide filter and a method of producing such a filter.

BACKGROUND

Filters of the waveguide type are conventionally made in the form of straight units, with one or more resonator cavities arranged along a straight centre line. The electrical path length of the integral resonator cavities and thus the waveguide filter as a whole is then the same as the mechanical length of the filter.

A disadvantage of such known waveguide filters is that their straight shape leads to certain requirements with regard to the size of the surface on which the filter is to be accommodated. If it is desired to reduce the surface area of the unit of which the waveguide filter is to form part, a limit is reached where conventional straight waveguide filters do not fit within the desired surface area of the unit.

From WO 93/01625, for example, a filter for electromagnetic waves, in particular microwaves, is previously known, in which circular cavities are angled relative to one another in groups, that is to say in such a manner that the filter as a whole does not follow a straight line. In this way, a certain flexibility is achieved as far as utilization of the space in, for example, a microwave unit is concerned. However, since the groups of cavities of which this filter consists are rectilinear, flexibility is reduced with regard to how the filter can be accommodated in another unit.

In the same manner, Japanese patent documents JP 58-161403 and JP 58-187001 disclose filter arrangements which comprise cavities that are not arranged in a straight line. The cavities described in these two documents are also circular, however, which reduces the flexibility with which the filter arrangements can be accommodated in another unit.

SUMMARY

A problem that is solved by the present invention is that of being able to reduce the area that is occupied by a waveguide filter.

Another problem that is solved by the present invention is that of increasing the possibilities of freely being able to position the input and output respectively of a waveguide filter.

A further problem that is solved by the invention is that of providing a method of producing a waveguide filter that occupies a smaller area than previously known waveguide filters of corresponding performance.

These problems are solved by a waveguide filter according to the invention being designed with an input and an output for the filter, and also one or more resonator cavities, at least one resonator cavity of which has a curved extension about its centre line. On account of this curved shape, the area required for the filter can be reduced.

For a curved resonator cavity, the electrical path length is determined essentially by the radius of curvature of the cavity, in other words the distance from the centre of curvature to the centre line of the resonator cavity. In order to obtain proper electrical characteristics of the filter as a whole, compensation for the mechanical length of the curved cavities must be carried out with respect to straight cavities with corresponding characteristics. This compensation is effected by first calculating the mechanical length of a straight cavity with the electrical characteristics that are desired for the curved cavity. Then, the mechanical length of the centre line of the curved cavity is compensated so as to allow for the fact that the cavity is curved.

By selecting the radius of curvature individually for the curved resonator cavities forming part of the filter, the input and output of the filter can be positioned in a desired manner.

In a preferred embodiment, the filter is designed as a band-pass filter, and forms part of the milled microwave block.

BRIEF DESCRIPTION OF THE DRAWINGS

The invention will be described in greater detail below with the aid of exemplary embodiments and with reference to the appended drawings, a cover having been removed in all the drawings for the sake of clarity, in which drawings

DETAILED DESCRIPTION

Figure 1:
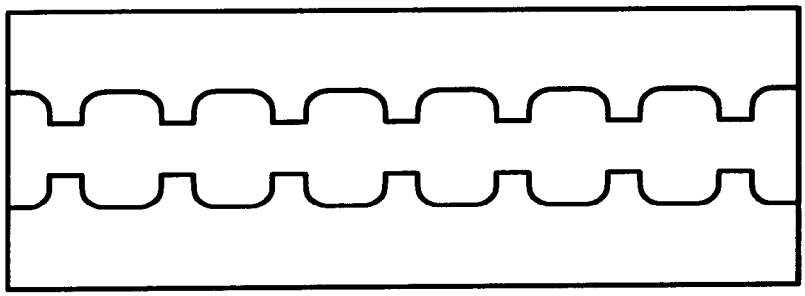
PRIOR ART FIG. 1
FIG. 1 shows a plan view of a known waveguide filter.
Figure 2:
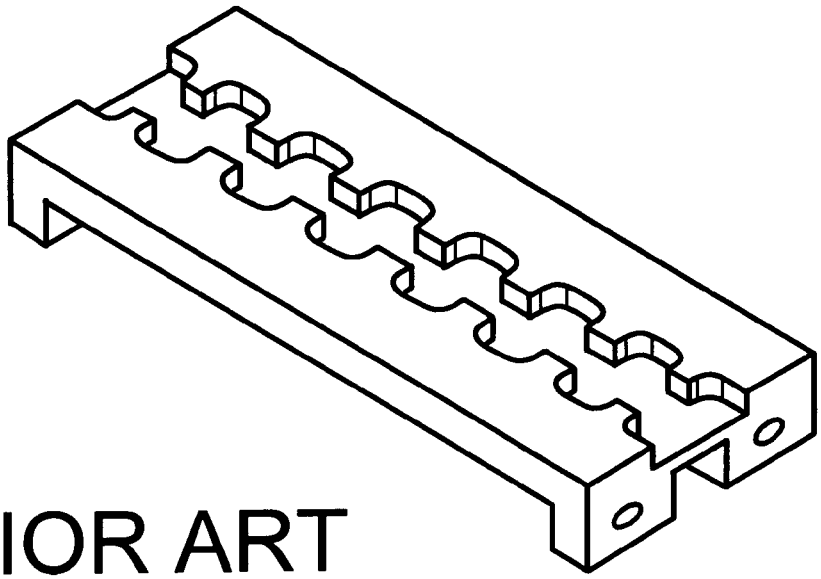
PRIOR ART FIG. 2
FIG. 2 shows a perspective view of the known waveguide filter of FIG. 1.

In order to facilitate the understanding of the invention, an example of prior art has been included in the drawings. Accordingly, FIGS. 1 and 2 show an example of the conventional type of waveguide filter described in the introduction, specifically a band-pass filter, which, in the form of a number of series-connected resonator cavities, is arranged in a microwave unit. The resonator cavities extend between an input to and an output from the filter. Each resonator cavity is bordered by two so-called diaphragms. Each resonator cavity also has a chosen mechanical length which is measured as the centre distance between the two diaphragms.

The mechanical length of the resonator cavities may be the same or mutually different, for adaptation to the desired electrical characteristics of the filter. One of the electrical characteristics it is desirable to influence is the electrical path length of the filter.

In the case with the straight filter shown in FIGS. 1 and 2, the mechanical length of the filter coincides essentially with its electrical path length. The mechanical dimensions of the filter thus depend to a great extent on the requirements for the electrical characteristics of the filter. Moreover, the positioning of the input and output of the filter, and the distance between the input and output of the filter are to a great extent fixed, which creates problems when it is desirable to reduce the area of the microwave unit of which the filter in FIGS. 1 and 2 forms part.

Figure 3:
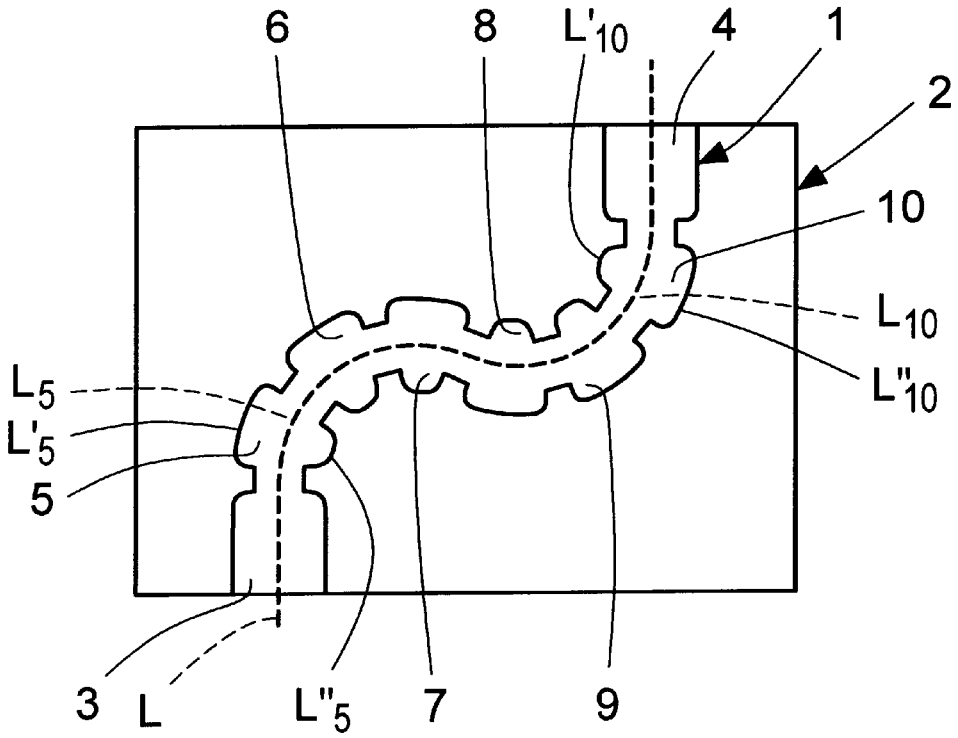
FIG. 3 shows an example of a waveguide filter according to the invention, in a plan view.
Figure 4:
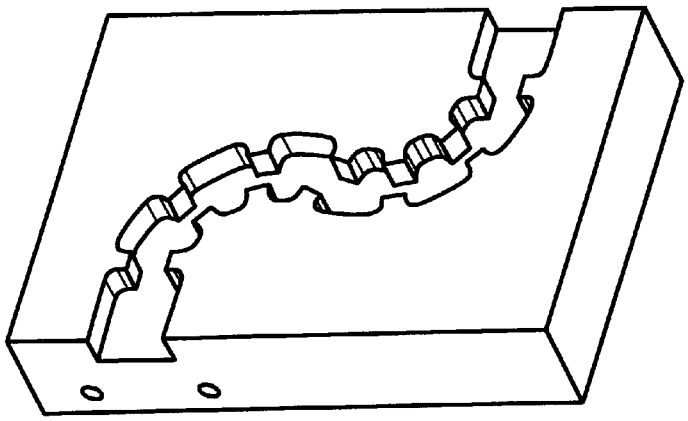
FIG. 4 shows a perspective view of the waveguide filter of FIG. 3.

Accordingly, FIGS. 3 and 4 show in plan view and perspective view respectively an example of a waveguide filter 1 according to the invention. In the example shown, the filter 1 consists of a band-pass filter which forms part of a microwave unit 2. In the example, the microwave unit 2 consists of a metal plate in which the filter 1 forms a continuous recess. However, the microwave unit 2 may of course contain further waveguides and waveguide components. A cover (not shown) closes the filter 1 when in use. The waveguide filter in the example has a rectangular cross-sectional shape, and extends between an input 3 to the filter and an output 4 from the filter, which, in the example, also form the input to and, respectively, the output from the microwave unit 2.

As emerges from the drawings, the filter 1 according to the invention consists of a number of series-connected resonator cavities 5–10, each cavity n having been given a curved extension about its respective centre line $L_n$. Each resonator cavity n has a corresponding pole in the filter 1 which, as mentioned, is a band-pass filter.

The band-pass filter shown in FIGS. 3 and 4 extends in an essentially S-shaped manner with two curved portions, but the filter 1 may of course be provided with an essentially arbitrary extension and a combination of curved and straight cavities, where the number of curved and, respectively, straight cavities is determined by, inter alia, the extension the filter is to have, and also the surface area available for the filter. It is also possible to have a filter which does not consist solely of series-connected cavities.

The curved cavities in the filter 1 in the example have been provided with such a curvature that each cavity n has an outer edge $L'_n$ and an inner edge $L''_n$ about its centre line $L_n$, where the length of the outer edge $L'_n$ of each cavity differs from the length of its inner edge $L''_n$.

In a straight waveguide, the mechanical extension of the waveguide is determined essentially by the electrical path length of the waveguide. Use is made of this relationship in order to be able to dimension the mechanical length of a curved waveguide according to the invention.

A method of calculating the mechanical extension that the centre lines $L_n$ should have in curved waveguides of the type of which the presonator cavities 5–10 according to the invention form part will be illustrated below.

Starting from the desired characteristics of the resonator cavity n, the dimensions for a straight resonator cavity are first calculated. A correction factor is then calculated, which is multiplied by the length L of the straight resonator cavity. The product obtained by multiplication then indicates the corrected length for the centre line $L_n$ in a corresponding curved cavity n. The correction factor may preferably be worked out with the aid of the formulas below:

$$\lambda_g := \frac{\lambda}{\sqrt{1-\left(\frac{\lambda}{2\cdot a}\right)^2}} \tag{1}$$

-continued $$\lambda_{g\phi} := \frac{1}{\sqrt{\frac{1}{\lambda_g^2}+\frac{1}{24\cdot R^2}\cdot\left[1-\left(\frac{12+\pi^2}{2\cdot\pi^2}\right)\cdot\left(\frac{2\cdot a}{\lambda}\right)^2+\left(\frac{15-\pi^2}{2\cdot\pi^2}\right)\cdot\left(\frac{2\cdot a}{\lambda}\right)^4\right]}} \tag{2}$$

where:

$\lambda$ is the centre wavelength for the frequency range for which the waveguide is intended, a is the width of the waveguide in millimeters, and R is the uncorrected radius of curvature of the centre line in millimeters.

The correction factor=$\lambda_{g\phi}/\lambda_g$(3)

And $L_n=L^*\lambda_{g\phi}/\lambda_g$ (4)

Figure 5:
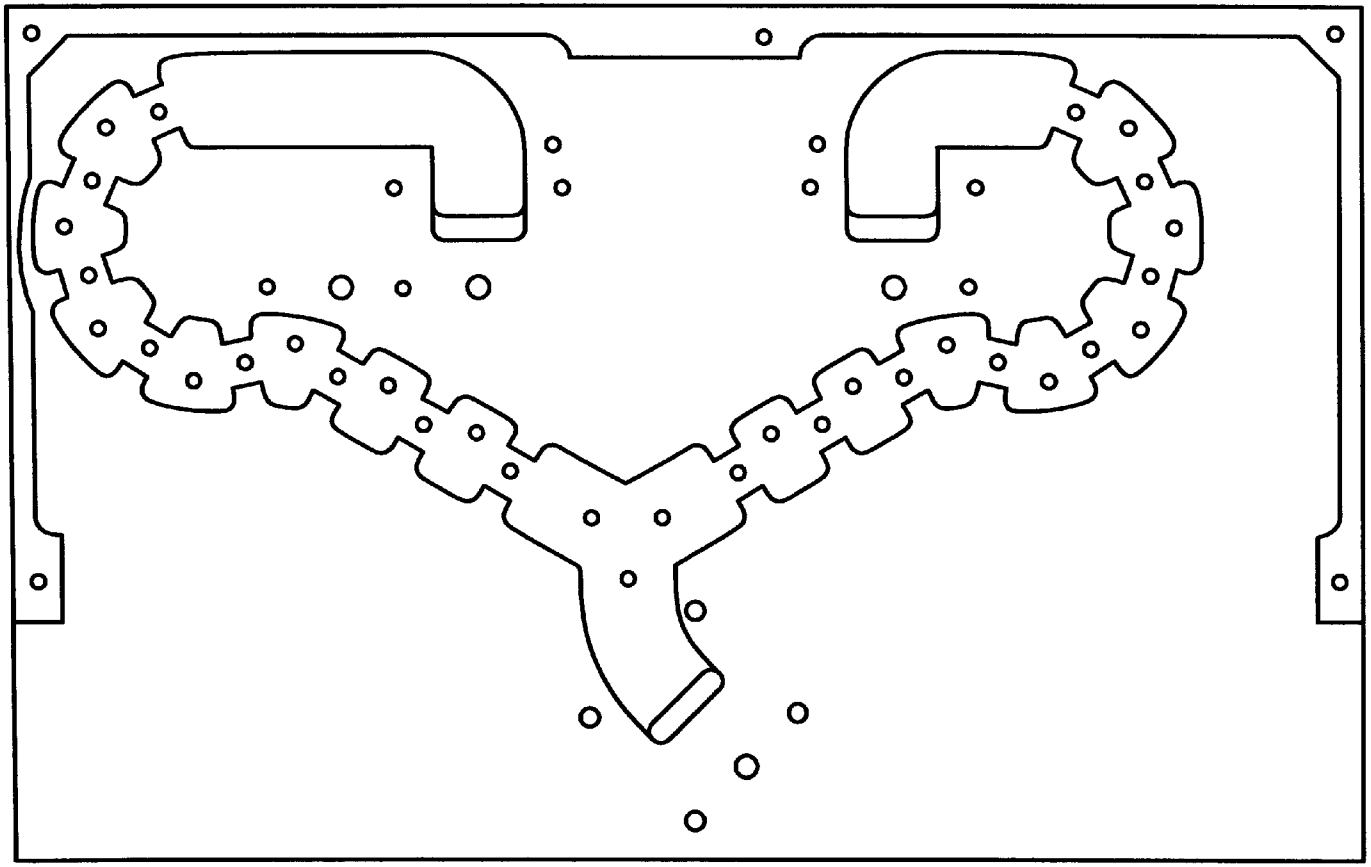
FIG. 5 shows a plan view of an alternative embodiment of the invention.
Figure 6:
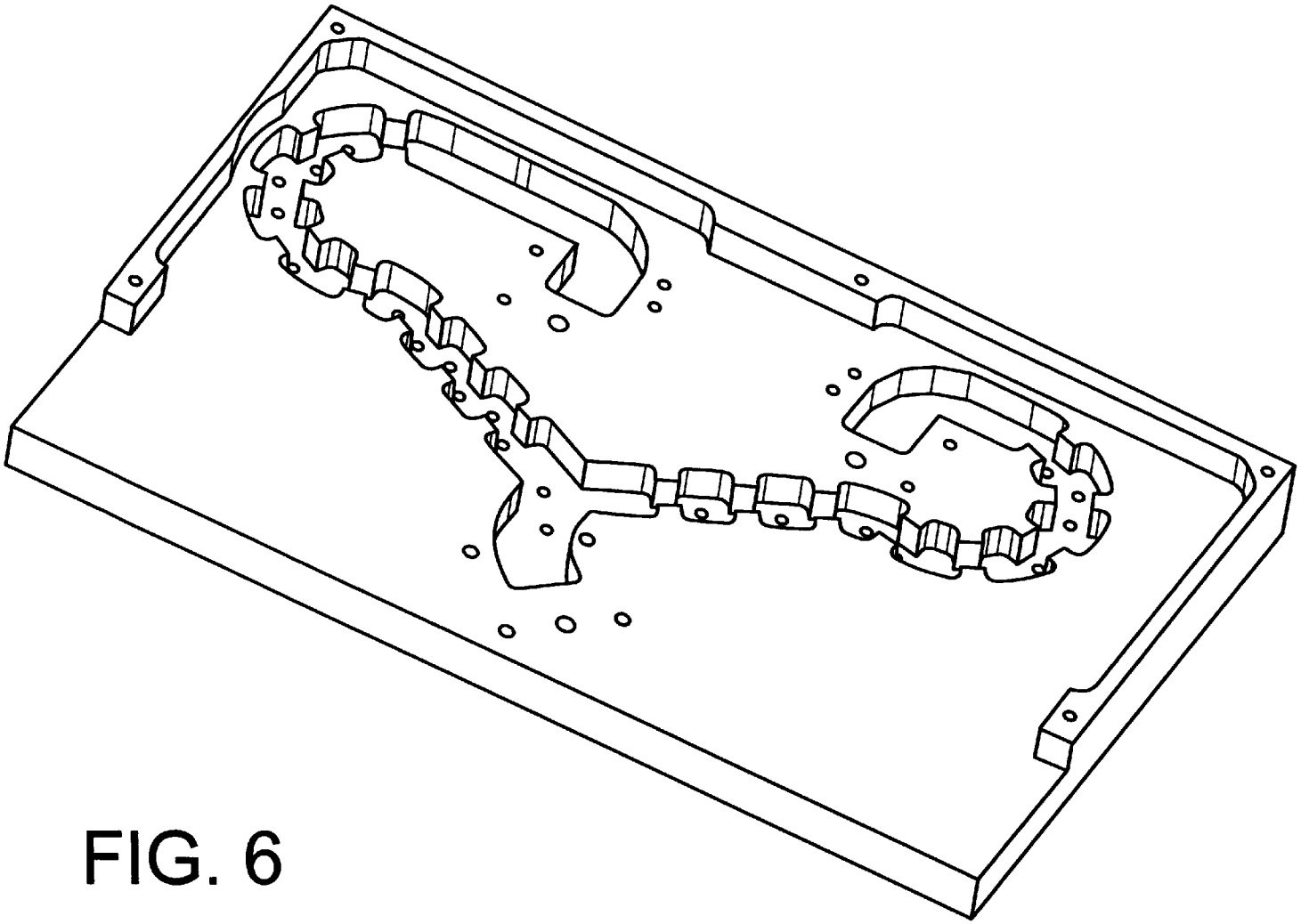
FIG. 6 shows a perspective view of the waveguide filter of FIG. 5.

In a particularly preferred embodiment, the band-pass filter 1 according to the invention forms part of a microwave unit 2 which is a solid block. FIGS. 5 and 6 show such a microwave block in a plan view and, respectively, a perspective view. It emerges from FIGS. 5 and 6 that the filter in this embodiment has a number of openings for so-called trimming screws, which preferably can be used in order to adjust the electrical characteristics of the filter. It also emerges from FIGS. 5 and 6 that the curved resonator cavities according to the invention can be used in order to determine the extension of the waveguide filter with great freedom.

The invention is not limited to the embodiments described above, but may be varied within the scope of the patent claims below. The microwave unit of which the filter according to the invention forms part may, for example, consist in its entirety of a waveguide instead of being a block of the type described above.

The waveguide filter of which the resonator cavities form part has been referred to as a band-pass filter in the description above. This is only one embodiment, curved resonator cavities of the type described above may also be used in waveguide filters with other characteristics, for example band-stop filters.

If the waveguide filter according to the invention is included in the form of a recess in a solid metal piece, this recess may be made using various methods. Examples of such methods are milling, casting, drilling or other shaping.

Figure 7A:
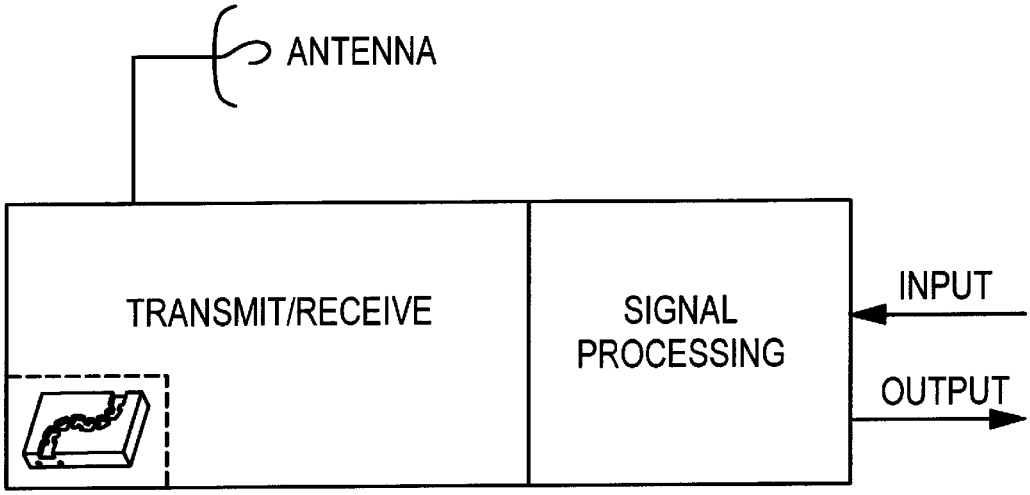
FIGS. 7A and 7B illustrate an example of a waveguide filter included in a microwave link and a radar system, respectively.
Figure 7B:
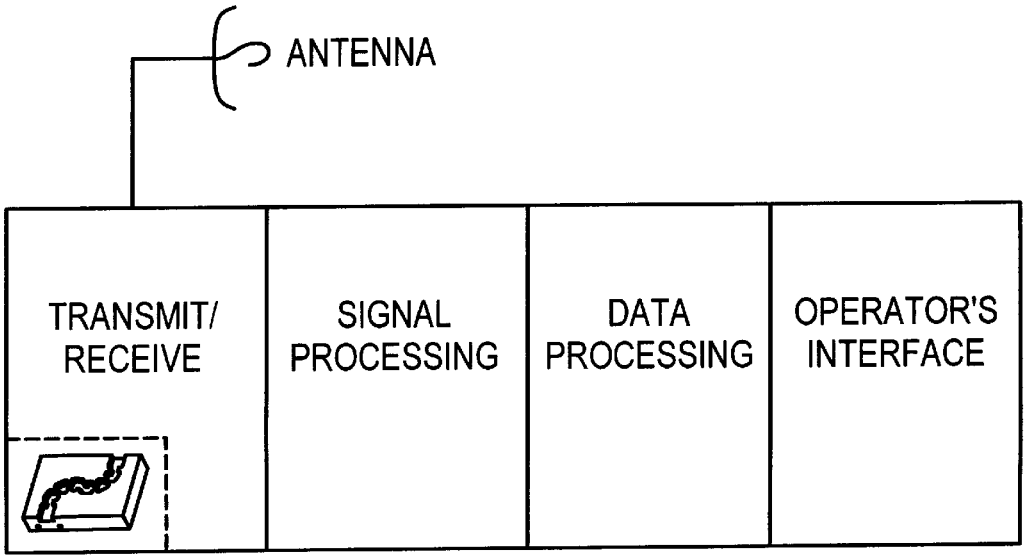

The waveguide filter according to the invention may of course be used in all applications where such filters are required, but two areas of application of which mention may be made in particular are radio links in the microwave range and radar systems. This is shown in FIGS. 7A and 7B which illustrate, by way of example, the waveguide filter of FIG. 4 as part of a microwave link and a radar system, respectively.

What is claimed is:

1. Waveguide filter comprising one or more resonator cavities which extend between an input to the filter and an output from the filter, where each resonator cavity in the filter exhibits a center line with a chosen extension and a mechanical length, which filter forms part of a microwave unit, wherein at least one of the resonator cavities of the filter has an outer edge and an inner edge which are not of the same length.

2. Waveguide filter according to claim 1, wherein at least two of the resonator cavities of the filter have curved extensions with respect to their center lines.

3. Waveguide filter according to claim 1, wherein at least three of the resonator cavities of the filter have curved extensions with respect to their center lines.

4. Waveguide filter according to claim 1, wherein at least two of the resonator cavities forming part of the filter are arranged in series.

5. Waveguide filter according to claim 1, wherein the total center line that is formed by the center lines of the resonator cavities that form part of the filter extends in an S-shaped manner with at least two curved portions.

6. Waveguide filter according to claim 1, wherein the resonator cavities forming part of the filter form a band-pass filter.

7. Waveguide filter according to claim 1, wherein the resonator cavities forming part of the filter form a band-stop filter.

8. Waveguide filter according to claim 1, wherein the length of the center lines of curved resonator cavities forming part of the filter are adapted in such a manner that their electrical path lengths are the same as in corresponding straight resonator cavities.

9. Waveguide filter according to claim 1, wherein the microwave unit of which the filter forms part is a milled block.

10. Waveguide filter according to claim 1, wherein the microwave unit of which the filter forms part is, itself, formed by a waveguide.

11. The waveguide filter according to claim 1, wherein the waveguide filter is part of a microwave radio link.

12. The waveguide filter according to claim 1, wherein the waveguide filter is part of a radar system.

13. Method of producing a waveguide filter forming part a microwave unit, the method comprising the following steps:

forming one or more resonator cavities which extend between an input to the filter and an output from the filter, and providing each resonator cavity with a center line with a chosen extension and mechanical length, wherein at least one of the resonator cavities of the filter is provided with an outer edge and an inner edge which are not of the same length.

14. Method according to claim 13, wherein at least two of the resonator cavities of the filter are provided with curved extensions with respect to their center lines.

15. Method according to claim 13, wherein at least three of the resonator cavities of the filter are provided with curved extensions with respect to their center lines.

16. Method according to claim 13, wherein at least two of the resonator cavities forming part of the filter are arranged in series.

17. Method according to claim 13, wherein the total center line that is formed by the center lines of the resonator cavities that form part of the filter is designed so that it extends in an S-shaped manner with at least two curved portions.

18. Method according to claim 13, wherein the resonator cavities forming part of the filter are designed so that they form a band-pass filter.

19. Method according to claim 13, wherein the method is implemented by milling in a continuous block, which block then forms the microwave unit of which the filter forms a part.

20. The method according to claim 13, wherein the waveguide filter is part of a microwave radio link.

21. The method according to claim 13, wherein the waveguide filter is part of a radar system.

* * * * *